US010556445B2

(12) United States Patent
Pathrose Vareed et al.

(10) Patent No.: US 10,556,445 B2
(45) Date of Patent: Feb. 11, 2020

(54) PRINTHEAD ASSEMBLIES

(71) Applicant: HEWLETT-PACKARD DEVELOPMENT COMPANY, L.P., Houston, TX (US)

(72) Inventors: Jerrin Pathrose Vareed, Singapore (SG); Boon Bing Ng, Vancouver, WA (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/095,001

(22) PCT Filed: Jul. 15, 2016

(86) PCT No.: PCT/US2016/042502
§ 371 (c)(1),
(2) Date: Oct. 19, 2018

(87) PCT Pub. No.: WO2018/013133
PCT Pub. Date: Jan. 18, 2018

(65) Prior Publication Data

US 2019/0152234 A1 May 23, 2019

(51) Int. Cl.

| | |
|---|---|
| ***B41J 2/35*** | (2006.01) |
| ***B41J 2/355*** | (2006.01) |
| ***B41J 2/135*** | (2006.01) |
| ***B41J 2/335*** | (2006.01) |
| ***B41J 29/38*** | (2006.01) |

(52) U.S. Cl.
CPC ..... *B41J 2/355* (2013.01); *B41J 2/135* (2013.01); *B41J 2/335* (2013.01); *B41J 29/38* (2013.01)

(58) Field of Classification Search
CPC ... B41J 2/35; B41J 2/355; B41J 2/3551; B41J 2/3553; B41J 2/3555; B41J 2/3556; B41J 2/3558; B41J 2/135; B41J 2/335; B41J 29/38
See application file for complete search history.

(56) References Cited

U.S. PATENT DOCUMENTS

| | | | |
|---|---|---|---|
| 4,931,986 | A | 6/1990 | Daniel et al. |
| 6,830,307 | B2 | 12/2004 | Anderson et al. |
| 8,864,260 | B1 | 10/2014 | Ge et al. |
| 8,914,612 | B2 | 12/2014 | Mekhiel et al. |

FOREIGN PATENT DOCUMENTS

| | | |
|---|---|---|
| WO | WO-2013048376 | 4/2013 |
| WO | WO-2015108527 | 7/2015 |
| WO | WO-2015160350 A1 | 10/2015 |

*Primary Examiner* — Kristal Feggins
(74) *Attorney, Agent, or Firm* — HP Inc. Patent Department

(57) ABSTRACT

Examples of a printhead assembly comprising an Erasable Programmable Read-only Memory (EPROM) having a predefined number of banks, with EPROM cells arranged in rows and columns in each of the banks are described. In one example, the printhead assembly comprises a shift register to generate, in consecutive shift register cycles, a row select signal, column select signal, and bank select signal to select a row, column, and bank, respectively, corresponding to an EPROM cell. A row select signal bus, column select signal bus and bank select signal bus is included in the printhead assembly to provide the row select signal, column select signal, and bank select signal, respectively, to the EPROM cell during the respective shift register cycles.

18 Claims, 7 Drawing Sheets

PRINTHEAD ASSEMBLIES

BACKGROUND

A thermal inkjet printer generally includes a printhead assembly having a memory component. The memory component stores information relating to characteristics of a print cartridge of the printhead assembly, such as information relating to pixel size, resolution, and security related data. The memory component communicates with an electronic controller of the inkjet printer to provide the stored information, relating to characteristics of the print cartridge, to the electronic controller. The electronic controller adjusts the operation of the thermal inkjet printer based on the characteristics of the print cartridge to ensure correct operation of the thermal inkjet printer.

The memory component is usually an Erasable Programmable Read-only Memory (EPROM) which is a non-volatile memory. The EPROM comprises numerous EPROM cells arranged in rows and columns of EPROM cells where each of the EPROM cells is programmable to store one bit of binary data, i.e., '0' or '1'.

BRIEF DESCRIPTION OF FIGURES

The detailed description is described with reference to the accompanying figures, wherein.

DETAILED DESCRIPTION

Figure 1:
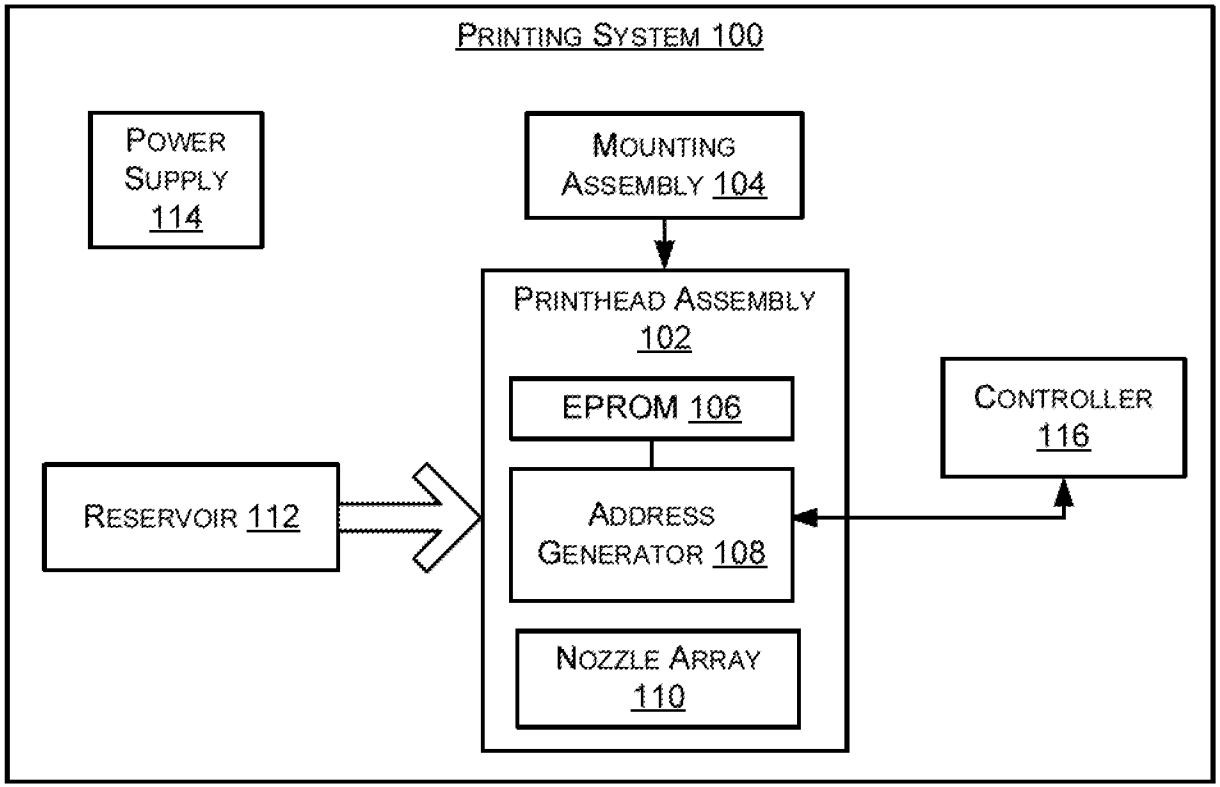
FIG. 1 illustrates a printing system, in accordance with one example implementation of the present subject matter.

Printhead assemblies used in inkjet printers (e.g., thermal inkjet printers, piezoelectric inkjet printers, etc.), generally comprise numerous functional components, such as nozzle arrays, and memory arrays along with circuitries that decode signals from a controller of the inkjet printer to actuate the nozzle arrays and the memory arrays. The numerous functional components and the intricate interconnections between them, results in the printhead assemblies having a complex structure. The complexity is further enhanced owing to the fact that the printhead assemblies are made as compact as possible to occupy minimum space in thermal inkjet printers that incorporate the printhead assemblies.

Generally, the memory arrays are Erasable Programmable Read-only Memory (EPROM) banks having EPROM cells arranged in a predefined number of rows and columns. The EPROM cells store information related to a print cartridge of a printhead assembly. The information is accessed by the controller of a thermal inkjet printer by reading bits of binary data stored in the EPROM cells. To read, and also to write binary data stored in the EPROM cells, the controller addresses each of the EPROM cells either one-by-one or otherwise. The controller generates data signals corresponding to a bank, row and column of an EPROM cell to be addressed. An addressing circuitry decodes the data signals and applies the same to the EPROM for addressing the EPROM cell. For the purpose, the addressing circuitry comprises shift registers that generate select signals to address the EPROM cell based on the data signals from the controller.

Generally, the number of the shift registers in an addressing circuitry is based on the hierarchical arrangement of EPROM cells in an EPROM. For instance, in an EPROM having EPROM cells arranged in banks, rows and columns, the addressing circuitry comprises a shift register each for selection of the bank, row and column corresponding to the EPROM cell to be addressed. If multiple sets of such banks are present in the EPROM, an additional shift register is employed for selection of a bank set corresponding to the EPROM cell to be addressed, from amongst the multiple sets of the banks, thus, resulting in a total of four shift registers.

The increased number of the shift registers, increases the silicon area of the printhead assembly. A printhead assembly may be a thin film structure fabricated using a semiconductor substrate having various thin film layers formed thereon. Manufacturers of printhead assemblies consistently explore ways to make the printhead assemblies compact in order to save the silicon area.

Described herein are example systems and methods for addressing EPROMs on printhead assemblies. In accordance with an example implementation of the present subject matter, the systems and methods for addressing the EPROMs make the number of shift registers in addressing circuitries of the printhead assemblies agnostic of the hierarchical arrangement of EPROM cells in the EPROMs, such that an EPROM cell may be addressed using a reduced number of shift registers. The example implementations provide for making the addressing circuitries for addressing EPROMs compact and in turn achieve reduction of the silicon area of the printhead assemblies.

In accordance with an example implementation of the present subject matter, a shift register is coupled to an EPROM having a plurality of banks. Each of the banks comprises EPROM cells arranged in rows and columns. The shift register receives a data signal from a controller associated with the EPROM. The data signal comprises a row select data, column select data, and bank select data specifying a row, column and bank, respectively, of an EPROM cell to be addressed by the controller. Based on the data signal, the shift register generates a row select signal, column select signal and bank select signal and applies the same to the EPROM sequentially for selecting the EPROM cell to be addressed by the controller. Since the same shift register provides the row select signal, column select signal as well as the bank select signal to the EPROM in a time-multiplexed manner, the use of multiple shift registers is eliminated.

The above discussed printhead assemblies are further described in the figures and associated description below. It should be noted that the description and figures merely illustrate the principles of the present subject matter. It will thus be appreciated that various arrangements that embody the principles of the present subject matter, although not explicitly described or shown herein, can be devised from the description and are included within its scope.

FIG. 1 illustrates a printing system 100, in accordance with one example implementation of the present subject matter. The printing system 100 may be a two-dimensional (2D) printing system or a three-dimensional (3D) printing system.

The inkjet printing system 100 includes a printhead assembly 102, mounted on the mounting assembly 104 that supports the printhead assembly 102. The printhead assembly 102 includes, among other things, an EPROM 106 and an address generator 108 for addressing EPROM 106. The printhead assembly 102 also includes a plurality of nozzle array 110 which, when actuated, ejects ink on a print medium, such as paper or cloth (not shown). In an example implementation where the printing system 100 is a 3D printing system, the nozzle array 110 may extrude layers of powered material that compose a three-dimensional object being printed. In other example 3D printing systems, the nozzle array 110 may eject a fluid agent onto a medium that comprises a layer of build material such that a layer-by-layer additive manufacturing process may be performed.

Additionally, the printing system 100 also comprise a reservoir 112 containing printing material (e.g., ink, fluid agent, or powered material) supplied to the nozzle array 110 for printing. As used herein, printing material may comprise, for example, ink, toner, fluids, powders, colorants, varnishes, finishes, gloss enhancers, binders, and/or other such materials that may be utilized in a printing process.

A power supply 114 provides power to various components of the printing system 100 for their operation while a controller 116 controls operations of the various components of the printing system 100.

The EPROM 106 contains a plurality of EPROM cells arranged in rows and column. A predefined number of rows and columns of EPROM cells constitute a bank of EPROM and accordingly, there can be a plurality of EPROM banks in the printhead assembly 102. As explained previously, the EPROM 106 contains information, relating to characteristics of the printhead assembly 102, such as information relating to pixel size, resolution, and security related data. The controller 116 retrieves the information from EPROM 106 to operate the printing system 100 based on the characteristics of the printhead assembly 102. For reading the information from the EPROM cells, the controller 116 addresses the EPROM cells by generating data signals corresponding to respective addresses of each of the EPROM cells that are to be read.

A data signal generated for addressing a given EPROM cell comprises a row select data, column select data, and bank select data indicative of a row, column, and bank, respectively, corresponding to the EPROM cell. The data signal is provided to the address generator 108 that decodes the data signal to generate a row select signal, column select signal and bank select signal. The row select signal selects the row of the EPROM corresponding to the EPROM cell, while the column select signal and the bank select signal, select the column and bank corresponding to the EPROM cell. The data signal provided to the address generator 108 is time multiplexed to include the row select data, column select data, and bank select data in consecutive time segments. Accordingly, the address generator 108 provides, to the EPROM, the row select signal, column select signal and the bank select signal corresponding to the given EPROM cell to be addressed, in a sequential manner.

Once the row select signal, column select signal, as well as the bank select signal have been applied, the EPROM cell is selected, or in other words addressed. Thereupon, the addressed EPROM cell is read by the controller 116 by application of a read signal. The EPROM is addressed in similar manner when data is to be written thereon.

The time multiplexed data signal and sequential application of the row select signal, column select signal and the bank select signal to the EPROM, allow addressing the EPROM cell using a single shift register. As apparent, the shift register outputs the row select signal, column select signal, and bank select signal in consecutive shift register cycles.

In accordance with one example implementation, the row select signal, column select signal, and bank select signal are applied to the EPROM 106 through row select signal bus, column select signal bus and bank select signal bus, respectively, included in the printhead assembly. This is explained in details with reference to FIG. 2 below.

Figure 2:
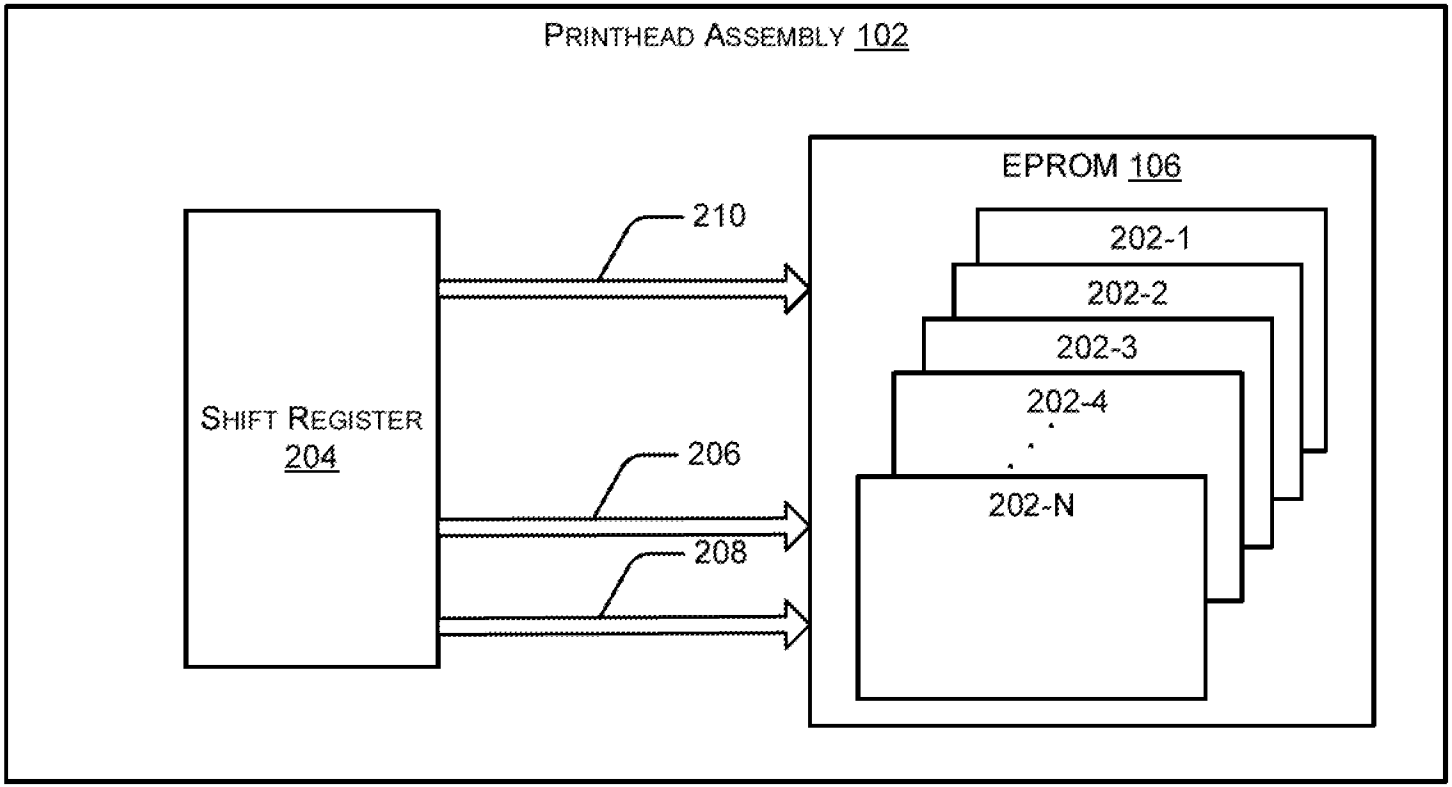
FIG. 2 illustrates a printhead assembly of the printing system according to an example implementation of the present subject matter.

FIG. 2 illustrates the example printhead assembly 102 comprising the EPROM 106 having a number of banks 202-1, 202-2 . . . , 202-N with EPROM cells arranged in rows and columns in each of the banks 202-1, 202-2 . . . , 202-N. In one example, the printhead assembly 102 comprises a shift register 204 to generate, in consecutive shift register cycles, the row select signal, column select signal, and bank select signal to select the row, column, and bank, respectively, corresponding to an EPROM cell. Row select signal bus 206, column select signal bus 208 and bank select signal bus 210 are included in the printhead assembly 100 to provide the row select signal, column select signal, and bank select signal, respectively, to the EPROM 106 during the respective shift register cycles.

Figure 3:
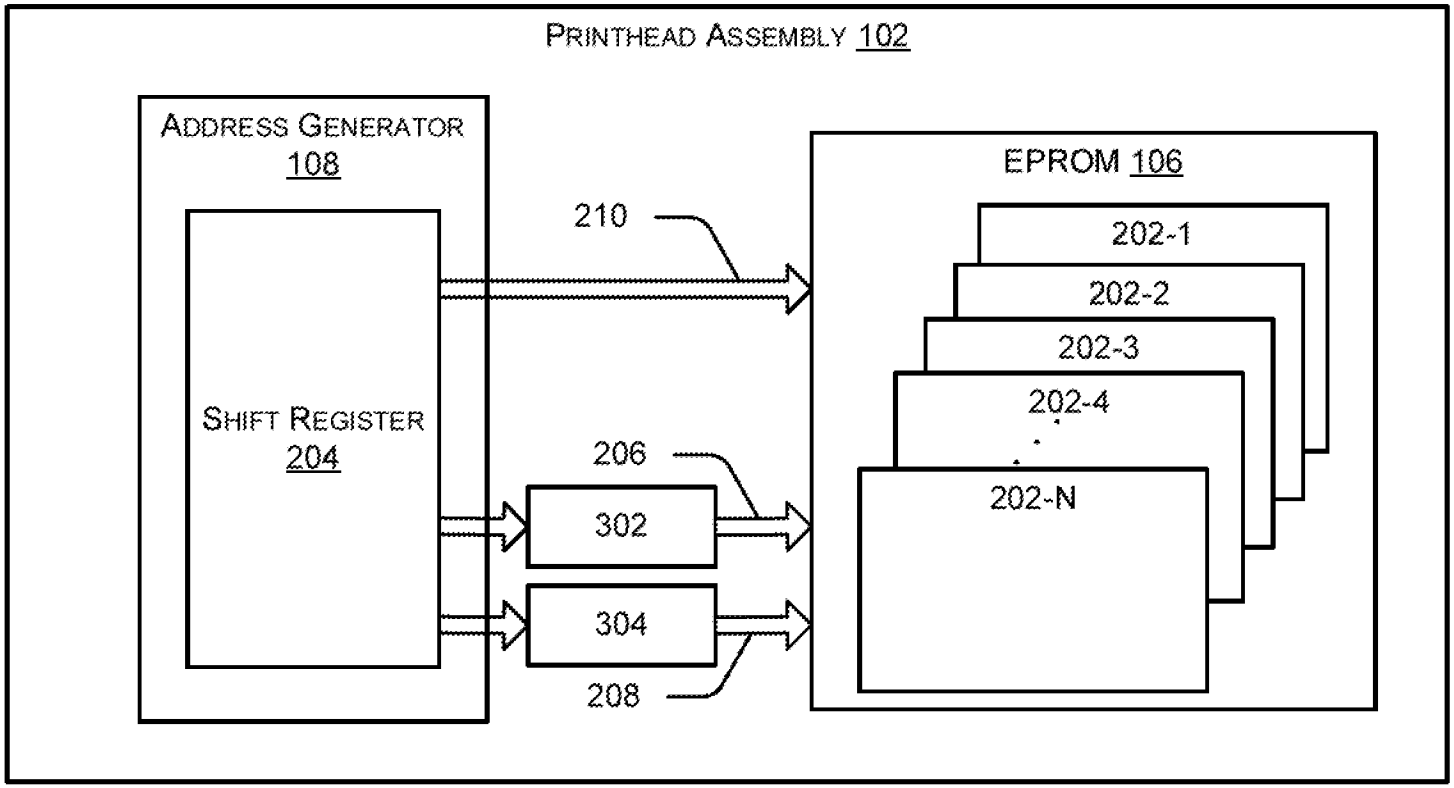
FIG. 3 illustrates the printhead assembly according to another example implementation of the present subject matter.

Reference is made to FIG. 3 for further details of the shift register 204. FIG. 3 shows an example implementation of the address generator 108 comprising the shift register 204. As explained above, the address generator 108 generates the address, i.e., the row select signal, column select signal, and bank select signal corresponding to the EPROM cell to be addressed, based on the data signals received from the controller 116. Since the data signal is time-multiplexed, the address generator 108, in an example, first receives a row select data, thereafter the column select data and finally the bank select data in consecutive time segments.

In the time segments in which the address generator 108 receives the row select data, the shift register 204 generates the row select signal and provides the same to the EPROM 106 over the row signal bus 206. Similarly, based on the example sequence of data signals considered in the present example, the shift register 204, thereafter generates the column select signal with the arrival of the column select data at the address generator 108. The column select signal is output to the EPROM 106 over the column select signal bus 208. This is followed by generation of the bank select signal, provided to the EPROM 106 over the bank select bus 210.

The row select signal bus 206 and column select signal bus 208 comprise row select switches 302 and column select switches 304, respectively. The row select switches 302 and the column select switches 304 are coupled to stages (shown later) of the shift register 204. The row select switches 302 and the column select switches 304 are controlled by the controller 116. The controller 116 activates the row select switches 302 during the time segments corresponding to the row select data so that the row select signal, generated by the shift register 204 in shift register cycles that correspond to time segments of the row select data, are applied to the EPROM 106. Similarly, the column select switches 304 are enabled during the time segments corresponding to the column select data.

The row select signal and column select signal remains logical HIGH until the bank select signal is applied to the EPROM 106 and as soon as the bank select signal is applied, the corresponding EPROM cell gets selected. The row select signal and column select signal remains logical HIGH for a predefined time period based on capacitances of the row and column transistor as explained subsequently.

Figure 4:
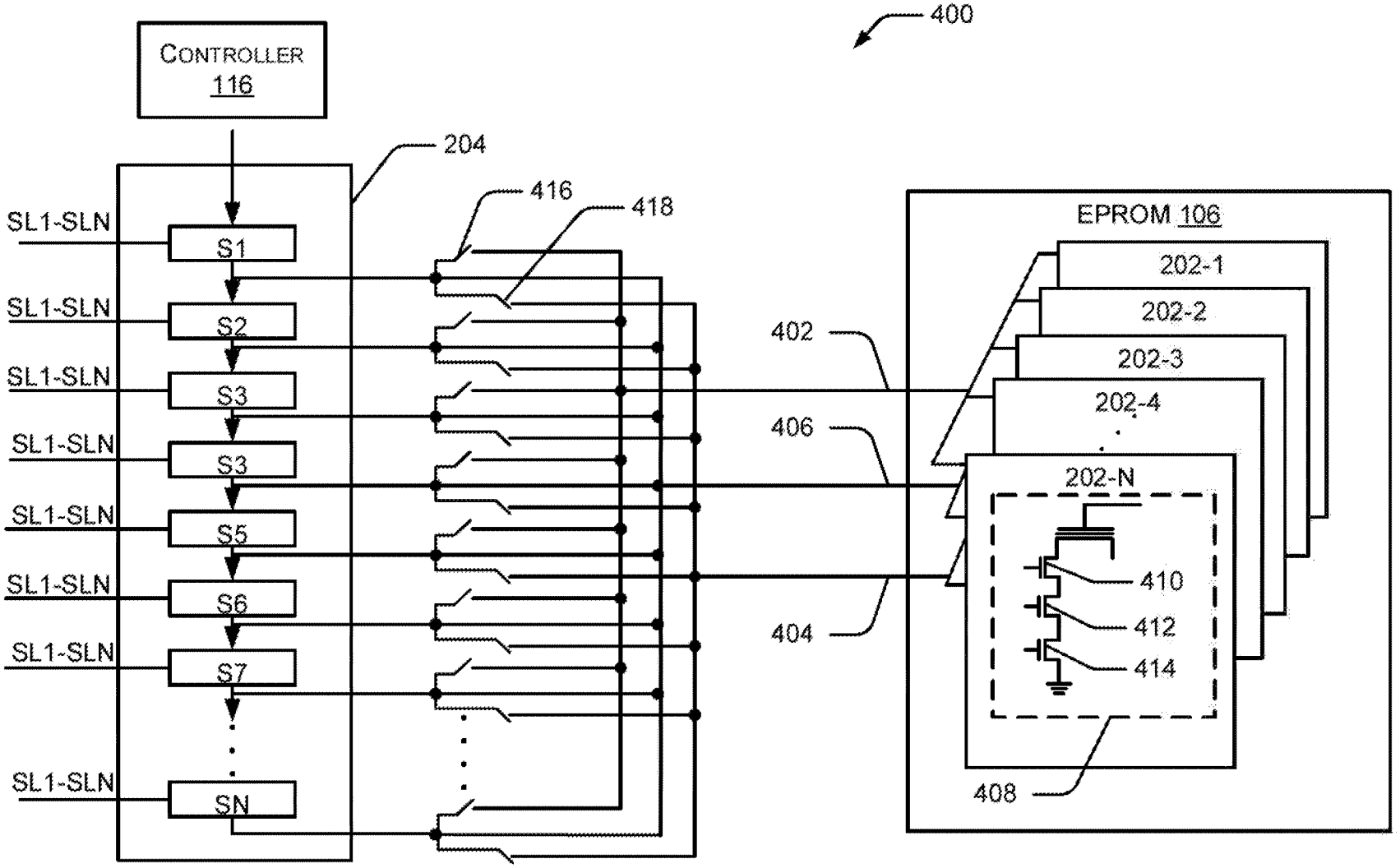
FIG. 4 illustrates a system for addressing an Erasable Programmable Read-only Memory (EPROM) on a printhead assembly, in accordance with one example implementation of the present subject matter.

FIG. 4 is an example implementation of a system 400 implementing the shift register 204 for addressing the EPROM 106 on the printhead assembly 102. In an example, the shift register 204 is an N-bit shift register 204. The EPROM 106, coupled to the shift register 204, in the present example, also comprises 'N' number for banks 202-1, 202-2 . . . , 202-N, each having 'N' rows and 'N' columns of EPROM cells.

In an example, the N-bit shift register 204 is a serial input parallel output shift register having 'N' stages S1-SN, thus providing 'N' outputs, such that output of the stages is coupled to the 'N' rows and 'N' columns of EPROM 106. In an example implementation, the data input to the shift register 204 is shifted by providing pre-charge signals through a select bus SL1-SLN coupled to each of the stages of the shift register 204. On application of the pre-charge signals to the shift register 204, the data shifts from one stage to the next stage of the shift register 204. In other example implementations, the stages of the shift register 204 may be implemented using flip-flops. In such example implementations, the input data provided to the shift register 204 is shifted based on clock signals (not shown).

The shift register 204 receives the row select data, column select data, and bank select data from the controller 116, based on which it generates the row select signal, column select signal, and bank select signal. The row column data is shifted through the 'N' stages of the shift register 204 and the output, i.e., the row select signal, is provided to the EPROM 106. The row select signal is provided to the EPROM through row select signal bus 402. Similarly, the column select data and bank select data is also shifted through the 'N' stages and the corresponding column select signal and bank select signal generated by the shift register 204 is provided to the EPROM 106 over column select signal bus 404 and bank select signal bus 406, respectively.

As mentioned above, the EPROM 106 comprises the banks 202-1, 202-2, . . . , 202-N each having EPROM cells arranged in N-rows and N-columns. Each EPROM cell has a row select transistor, a column select transistors and a bank select transistor. An EPROM cell 408 having a row select transistor 410, a column select transistor 412, and a bank select transistor 414 is shown in FIG. 4. The EPROM cell 408 is selected when the row select transistor 410, the column select transistor 412, and the bank select transistor 414 are simultaneously ON.

Also, the EPROM cell 408 has a row select port, a column select port and a bank select port (not shown), coupled to the respective gates of the row select transistor 410, column select transistor 412, and bank select transistor 414. The row select port, the column select port, and the bank select port of the EPROM cell 408 are coupled to the row select signal bus 402, column select signal bus 404, and bank select signal bus 406, respectively. Each of the EPROM cells, in the EPROM 106, replicate the same structure in the array and accordingly the row select port, the column select port, and the bank select port of each of the EPROM cells is coupled to the row select signal bus 402, the column select signal bus 404, and the bank select signal bus 406, respectively.

In the present example implementation, the row select signal bus 402, the column select signal bus 404, and the bank select signal bus 406 comprises a plurality of row select signal lines, column select signal lines, and bank select signal lines (not shown), respectively. The number of row select signal lines, column select signal lines, and bank select signal lines is equal to the number of the rows, columns, and bank of the EPROM, i.e., 'N'. Accordingly, a row select signal line of the row select signal bus 402 is coupled to the row ports of all the EPROM cells of $1^{st}$ row, a $2^{nd}$ row select signal line is coupled to the row ports of all the EPROM cells of $2^{nd}$ row and so on. Similar connections exists for the column select signal lines and bank select signal lines.

In an example implementation, the bank select signal bus 406 is directly coupled to the output of the shift register 204, hence when the shift register 204 outputs the bank select signal, the same is provided to the bank port of the EPROM 106. The row select signal bus 402 and the column select signal bus 404 are coupled to the outputs of the shift register 204 via the row select switches 302 and column select switches 304, respectively. A row select switch 416, from amongst the row select switches 302, is provided on each of the 'N' row select signal lines on the row select signal bus 402. In a similar manner, a column select switch 418, is provided on each of the 'N' column select signal lines.

The operation of the row select switches 302 and column select switches 304 is controlled by a row enabling signal and column enabling signal respectively, which are provided to the row select switches 302 and column select switches 304 by the controller 116. When the row enabling signal and the column enabling signal goes logical HIGH, the row select switches 302 and column select switches 304 are turned ON and the output of the shift register 204 is coupled to the row select signal bus 402 and column select signal bus 404, respectively. The row select switches 302 and column select switches 304 can be N-type Metal Oxide-Semiconductor (NMOS) based switches or P-type Metal Oxide-Semiconductor (PMOS) based switches, for example. In an example implementation where shift register is implemented by flip-flops using Complementary Metal-Oxide-Semiconductor (CMOS) logic, row select switches 302 and column select switches 304 may be, for example, transmission gates.

In operation, to address an EPROM cell, time-multiplexed data signal is provide to the shift register 204. While the row select data, column select data, and bank select data may be time-multiplexed in the data signal in any sequence, an example data signal may include row select data, followed by column select data and bank select data in consecutive time segments. Accordingly, in the present example, the row select data is provided to the shift register 204 first, and simultaneously the row enabling signal is made logical HIGH coupling the outputs of the shift register 204 to the row select signal bus 402. Thus, the controller 116 generates the row enabling signal in accordance with the time segments of the data signal that carry the row select data. The row select signal is provided to the row select signal bus 402 and finally to the row ports of the EPROM cells. The row port, as explained earlier, is coupled to the row transistor of the all the EPROM cells of the EPROM 106. Thus, the row select signals are provided to the row transistors, whose gate capacitance holds the signal for a predefined time. Thus, the row of the EPROM 106 corresponding to the row select data remains selected for some time.

Subsequent to the row select data, time segments corresponding to the column select data occur in the data signal and the column select data is provided to the shift register 204. As the shift register 204 outputs the column select signal, the column select switches 304 are turned ON by the column enabling signal and a column of the EPROM is selected in a manner similar to selection of the row. The gate capacitance of the column transistor too retains the charge for a predefined time. Accordingly, at the end of the time segments corresponding to the column select data, both the row and column corresponding to the EPROM cell to be addressed are selected.

As the time segments corresponding to the column select data ends, time segments corresponding to the bank select data follow and bank data signal is provided to the shift register 204. The bank select data overwrites the column select data or the row select data, as the case may be depending upon the sequence of row select data, column select data and bank select data in the data signal. The bank select signal generated by the shift register 204 is provided to the EPROM 106 over the bank select signal bus 406, selecting the corresponding bank. Since the row and column are selected prior to the application of the bank select signal, the corresponding EPROM cell gets selected. Upon selection of the EPROM cell, a read/write signal is provided to the EPROM for reading or writing the same.

In an example implementation of the present subject matter, more number of EPROM cells can be addressed by the shift register 204 by including additional data in the data signal. For instance, multiple EPROM bank sets (not shown) may be implemented in the EPROM 106. Each of the EPROM bank sets comprises 'N' number for banks alike the banks 202-1, 202-2 . . . , 202-N. Accordingly, the time multiplexed data signal, provided to the shift register 204, includes, in addition to the row select data, column select data, and bank select data, a bank set select data indicative of a bank set, from amongst the multiple EPROM bank sets, corresponding to an EPROM cell to be selected. It will be understood that in such example implementations, the EPROM cells in the EPROM 106 have an additional port, i.e., a bank port, apart from the row select port, column select port and bank select port described above.

Figure 5:
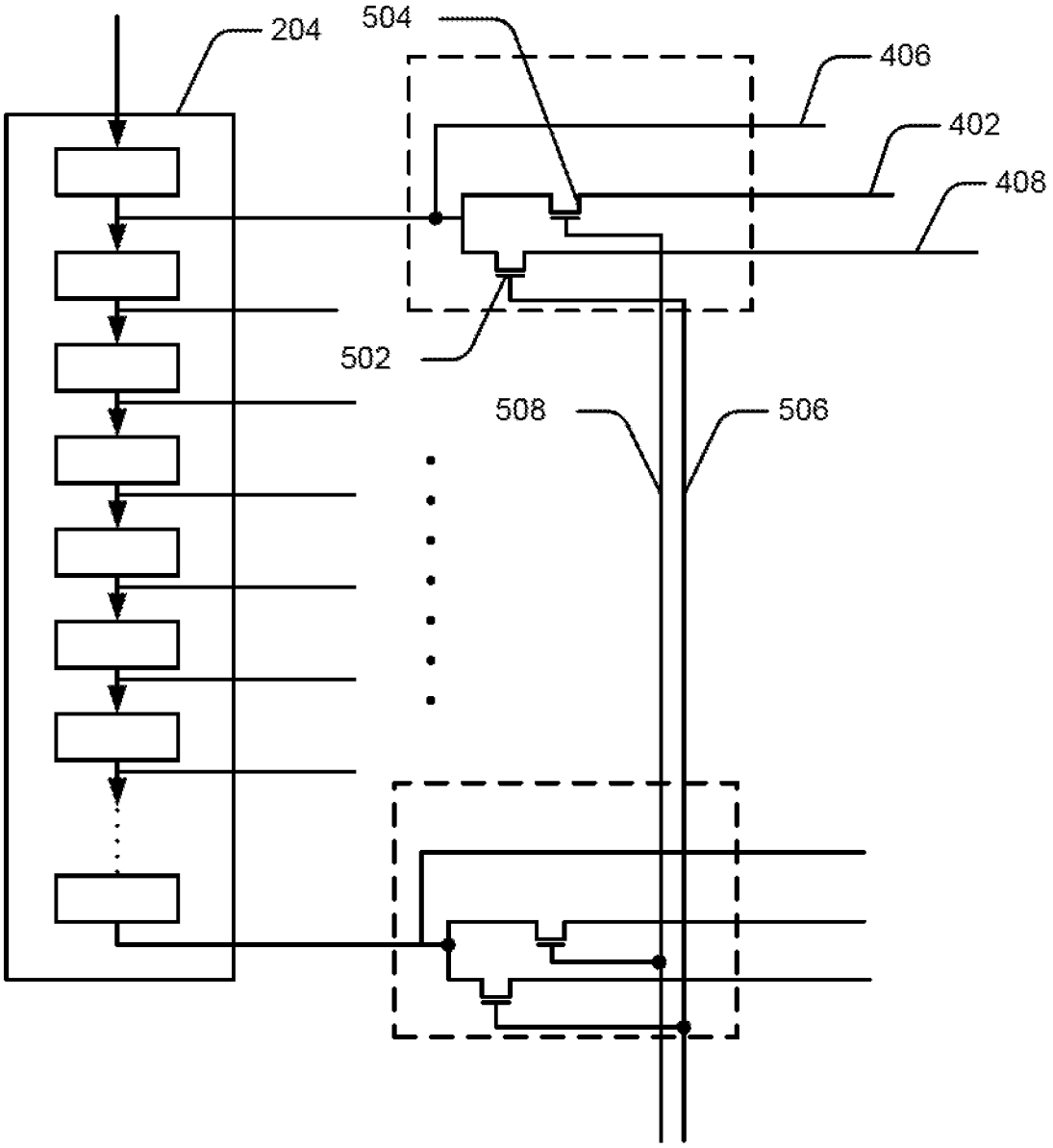
FIG. 5 illustrates the system for addressing the EPROM according to another example implementation of the present subject matter.

FIG. 5 illustrates the system 400 for addressing the EPROM 106 according to another example implementation of the present subject matter. The row select switches 302 and column select 304, are depicted in the example implementation illustrated in FIG. 5. As explained with reference to FIG. 4, the stages of the shift register 204 are coupled to the bank select signal bus 406 directly, while they are connected to the row select bus 402 and the column select bus 404 via the row select switches 302 and column select switches 304, respectively. In example implementation illustrated in FIG. 5, the row select switches 302 and column select switches 304 are transistors. For the simplicity of representation, a row select transistor switch 502 and column select transistor switch 504 corresponding to one of the stages of the shift register 204 are shown in FIG. 5. Needless to say that similar arrangement exists is for all the stages of the shift, register 204.

In an example implementation, the row select transistor switch 502 and column select transistor switch 504 are NMOS transistors. The switches 502 and 504 are controlled by the row enabling signal and column enabling signal, respectively. A row enabling bus 506 and column enabling bus 508 carry the row enabling signal and column enabling signal from the controller 116 to the row select transistor switch 502 and column select transistor switch 504, respectively. The row enabling signal is provided to the gate of row select transistor switch 502. When the row enabling signal is logical HIGH, the row select transistor switch 502 turns ON and the row select signal bus 402 is coupled to the EPROM 106, hence providing row select signal. Similarly, the column enabling signal turns the column select transistor switch 504 ON to provide the column select signal over the column select signal bus 404 to the EPROM 106. The bank select signal is provided to the EPROM 106 by directly coupling the bank select signal bus 406 with the stages of the shift register 204, as explained with reference to FIG. 4.

Figure 6:
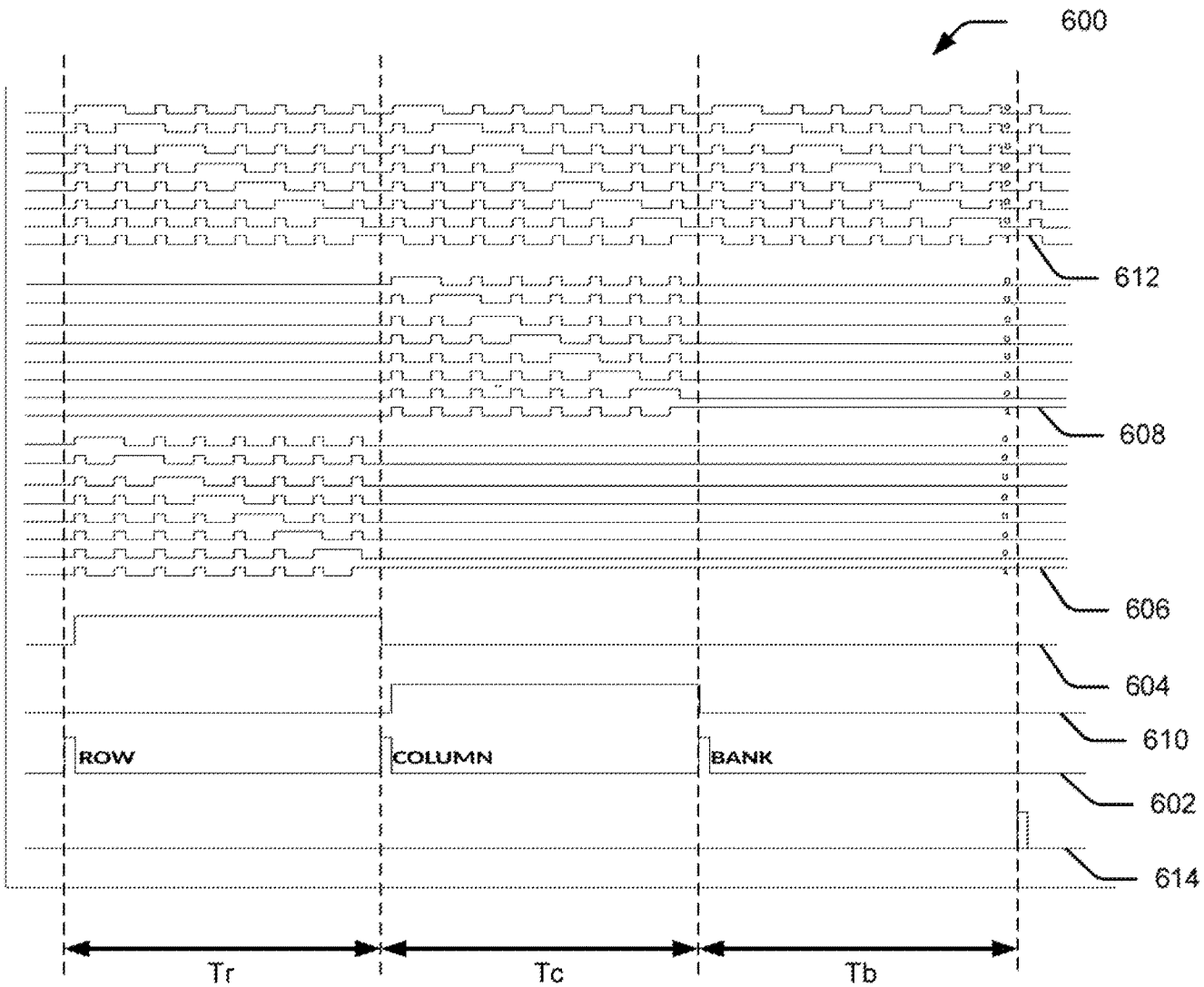
FIG. 6 illustrates a timing diagram for addressing an EPROM on a printhead assembly, in accordance with one example implementation of the present subject matter.

FIG. 6 illustrates a timing diagram 600 for addressing the EPROM 106 on the printhead assembly 102, in accordance with one example implementation of the present subject matter. The timing diagram 600 is provided with respect to an example implementation of the EPROM 106 where the EPROM 106 comprises 8 banks, with each bank having 8 rows and 8 columns of EPROM cells. Thus, in the present example implementation, the shift register 204 coupled to the EPROM 106 is accordingly a 8-bit shift register. The waveforms shown in the example timing diagram 600 are signals generated by the controller 116 and the shift register 204 for selecting the EPROM cell corresponding to $8^{th}$ row, $8^{th}$ column and $8^{th}$ bank of the EPROM 106.

In the timing diagram 600, the waveform 602 shows the time-multiplexed data signal wherein the time segments corresponding to the row data signal, column data signal and bank data signal are shown as Tr, Tc and Tb, respectively. In the time segments Tr corresponding to the row data signal, the row data signal is provided to the shift register 204 by the controller 116 and the row selection enabling signal is made logical HIGH closing the row select switches 302. The waveform 604 in the timing diagram 600, depicts the row selection enabling signal. The row data signal is shifted through the stages of the shift register 204 and the corresponding row select signal that is to select the $8^{th}$ row of the EPROM cells n the EPROM banks is applied to the EPROM 106. The waveform 606 corresponds to the row select signal.

As mentioned previously, in an example implementation, the shift register 204 may be implemented using a NMOS dynamic logic. In such an implementation, pre-charge signals, depicted as small interval signals in the waveform 806 are applied to the shift register 204 to shift the input data through the stages of the shift register 204. In example implementations where the shift register 204 is implemented using a CMOS logic, the pre-charge signals may be absent.

Since the row select signal that is to select the $8^{th}$ row, the $8^{th}$ row select signal, shown as waveform 606, is high. Likewise, in the time segments Tc corresponding to the column data signal, the $8^{th}$ column select signal, shown as waveform 608, is high. The column enabling signal, shown as waveform 610, closes the column select switches 304 at time segments Tc corresponding to the column data signal. The bank select signal is also generated in the same manner, by shifting the bank data in the time segment Tb. To select the $8^{th}$ bank of the EPROM 106, the $8^{th}$ bank select signal is made high, as depicted by the waveform 612. At the end of time segments Tb corresponding to the bank select data, the $8^{th}$ row, $8^{th}$ column, and $8^{th}$ bank are selected, which results in selection of the EPROM cell corresponding to the $8^{th}$ row, $8^{th}$ column, and $8^{th}$ bank. At the end of time segments Tb, a read/write signal, depicted as waveform 614, is applied to the selected EPROM cell to read or write data on to the selected EPROM cell.

In an example, if an EPROM cell in the 7th row of the EPROM 106 is to be selected, the row select data is provided to the shift register 204 after a delay of one pre-charge cycle.

Accordingly, when the row enabling signal goes LOW at the end of the time segment Tr, the row select signal shifts to the 7th stage thus enabling the 7th row of the EPROM 106. In a similar manner, the data signal indicative of the address of an EPROM cell is shifted and applied to the EPROM 106 to select any one of the 'N' rows, columns and banks.

Figure 7:
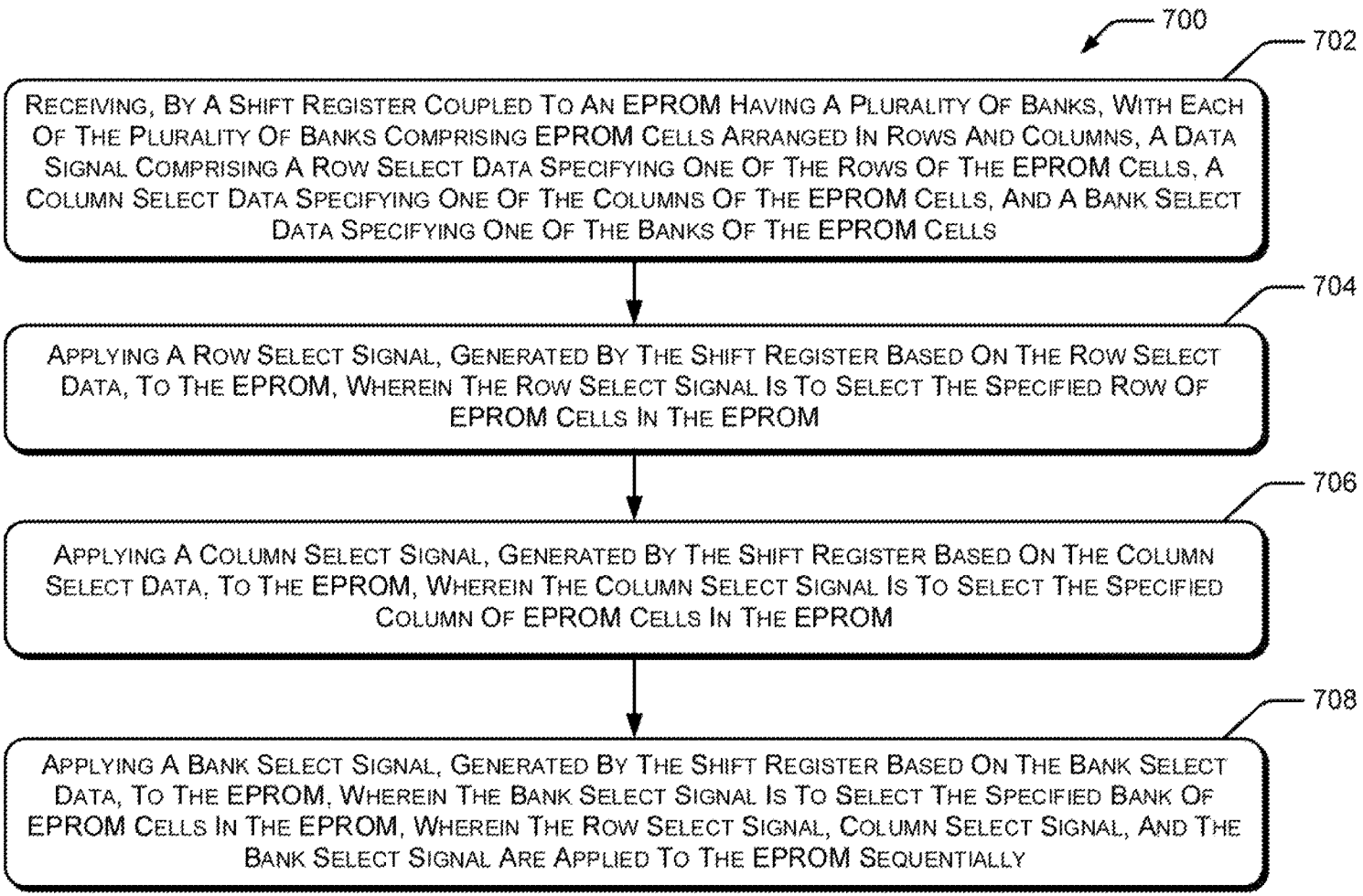
FIG. 7 illustrates a method for addressing an EPROM on a printhead assembly, in accordance with an example implementation of the present subject matter.

FIG. 7 illustrates a method 700 for addressing an EPROM on a printhead, according to an example of the present subject matter. The order in which the method 700 is described is not intended to be construed as a limitation, and any number of the described method blocks may be combined in any order to implement the method 700, or an alternative method.

It will be understood that while the method 700 may be implemented in any device implementing a system for addressing an EPROM, in the example implementations discussed herein the method 700 is implemented in a printing device that incorporates a printhead assembly comprising the EPROM. Examples of such printing devices include, 2D printing systems, 3D printing systems, and printer-cum-scanner devices. For the ease of explanation, the steps of the method 700 are explained in reference to the above-described printing system 100 that includes the printhead assembly 102 comprising the EPROM 106.

Referring to block 702 of the method 700, a shift register, such as the shift register 204, coupled to the EPROM 106 receives a data signal. The EPROM 106 has a plurality of banks, with each bank including EPROM cells arranged in rows and columns. The data signal comprises row select data, column select data, and bank select data indicative of a row, column and bank, respectively, of an EPROM cell to be addressed.

At block 704, a row select signal is generated by the shift register 204 based on the row select data and is applied to the EPROM 106. The row select signal is to select the row corresponding to the EPROM cell to be addressed. Similarly, at block 706 and block 708, following the row select signal, the column select signal and bank select signal are sequentially applied to the EPROM to select the column and bank corresponding to the EPROM cell to be addressed, respectively.

As explained previously, applying the row select signal and column select signal comprises shifting the row select data and column select data, respectively, in the shift register 204 and providing the output of the shift register 204 to the EPROM 106 through the row select signal bus 206 and column select signal bus 208, respectively. The switches 302 and 304 incorporated in the row select signal bus 206 and column select signal bus 208 are also enabled in the corresponding sequence, as explained earlier, to allow the row select signal bus 206 and column select signal bus 208 to be applied to the EPROM 106. The row selection enabling signal and the column selection enabling signal generated by the controller 116 associated with the EPROM 106, controls the switches 302 and 304.

Likewise, to generate the bank select signal, the shift register 204 shifts the bank select data through the stages of the shift register 204. The bank select data is received by the shift register 204 after the row select data and column select data and overwrites the row select data and column select data. Accordingly, in shift register cycles that correspond to the bank select data, the shift register 204 output the bank selects signal and applies the same to the EPROM 106.

Thus, the row select signal, column select signal, and bank select signal is output by the shift register 204 in consecutive shift register cycles and are applied to EPROM 106 sequentially. Since the EPROM cell receives the row select signal, column select signal, and bank select signal in quick successions, the EPROM cell remains selected as a read/write signal is applied to read/write data from the addressed EPROM cell. Accordingly, the present method 700 provides for a technique to address the EPROM 106 based on the shift register 204 alone and avoiding use of multiple such shift registers.

In the example implementation discussed in context of method 700, the row of the EPROM cell to be selected is addressed first, followed by the column and subsequently the bank. In various example implementations, the sequence of addressing the row, column and bank may be varied. Accordingly, six sequences of time segments corresponding to row select data, column select data and bank select data may exist in a given data signal. As apparent based on the above description, an enabling signal corresponding to the row, column or bank being addressed last is not provided.

Although examples for the present disclosure have been described in language specific to structural features and/or methods, it should stood that the appended claims are not necessarily limited to the specific features or methods described. Rather, the specific features and methods are disclosed and explained as examples of the present disclosure.

We claim:

1. A system for addressing an Erasable Programmable Read-only Memory (EPROM) on a printhead assembly, the system comprising:

a plurality of banks, each comprising an EPROM array having EPROM cells arranged in rows and columns, each of the EPROM cells having a bank select port, a row select port, and a column select port;

a controller to generate a data signal to address an EPROM cell, wherein the data signal is time multiplexed to include row select data, column select data, and bank select data indicative of one of the rows, columns and banks, respectively, corresponding to the EPROM cell, in predefined time segments;

a shift register including a plurality of stages, to generate sequentially, based on the data signal, a row select signal, column select signal and bank select signal to select the EPROM cell, each of the plurality of stages to provide the bank select signal to the bank select port of the EPROM cells;

a row select switch, coupled to each of the plurality of stages, being activated by the controller during the time segments corresponding to the row select data to provide the row select signal to the row select port of the EPROM cells; and a column select switch, coupled to each of the plurality of stages, being activated by the controller during the time segments corresponding to the column select data to provide the column select signal to the column select port of the EPROM cells.

2. The system as claimed in claim 1, wherein the controller provides a signal to read/write the EPROM cell to the EPROM subsequent to the predefined time segments corresponding to the row select data, column select data and bank select data.

3. The system as claimed in claim 1, wherein a gate capacitance of the row select port of the EPROM cell is to retain charge based on the row select signal and a gate capacitance of the column select port of the EPROM cell is to retain charge based on the column select signal up to the time segments corresponding to the bank select data, wherein the time segments correspond to the time-multiplexed data signal.

4. The system as claimed in claim 1, further comprising multiple EPROM bank sets, wherein one of the multiple EPROM bank sets includes the plurality of banks, and wherein the data signal is to additionally include a bank set select data.

5. The system as claimed in claim 1, wherein the row select switch and the column select switch is one of a N-type Metal-Oxide-Semiconductor (NMOS), P-type Metal-Oxide-Semiconductor (PMOS) and a Complementary Metal-Oxide-Semiconductor (CMOS) based switch.

6. The system as claimed in claim 1, wherein the time multiplexed data signal and sequential generation of the row select signal, the column select signal and the bank select signal to the EPROM, allow addressing the EPROM cells using a single shift register.

7. A printhead assembly comprising:

an Erasable Programmable Read-only Memory (EPROM) comprising a predefined number of banks, with EPROM cells arranged in rows and columns in each of the banks;

a shift register to generate, in consecutive shift register cycles, a row select signal, column select signal, and bank select signal to select a row, column, and bank, respectively, corresponding to one of the EPROM cells to be selected;

a row select signal bus to provide the row select signal to the EPROM during a shift register cycle when the shift register generates the row select signal;

a column select signal bus to provide the column select signal to the EPROM during a shift register cycle when the shift register generates the column select signal; and a bank select signal bus to provide the bank select signal to the EPROM during a shift register cycle when the shift register generates the bank select signal.

8. The printhead assembly as claimed in claim 7, wherein the row select signal bus and column select signal bus comprise row select switches and column select switches, respectively, the row select switches and the column select switches being coupled to stages of the shift register.

9. The printhead assembly as claimed in claim 8, wherein the row select switches and column switches are controlled by a controller associated with the EPROM.

10. The printhead assembly as claimed in claim 8, further comprising a row enabling bus and a column enabling bus to provide a row selection enabling signal and a column selection enabling signal to the row select switches and column select switches, respectively.

11. The printhead assembly as claimed in claim 8, wherein the row select switches and column switches are NMOS switches.

12. The printhead assembly as claimed in claim 7, wherein signal generation is time-multiplexed, and the row select signal, the column select signal and the bank select signal are generated in consecutive time segments.

13. A method of addressing a Erasable Programmable Read-only Memory (EPROM) cell on a printhead assembly, the method comprising:

receiving, by a shift register coupled to an EPROM having a plurality of banks, with each of the plurality of banks comprising EPROM cells arranged in rows and columns, a data signal comprising a row select data specifying one of the rows of the EPROM cells, a column select data specifying one of the columns of the EPROM cells, and a bank select data specifying one of the banks of the EPROM cells;

applying a row select signal, generated by the shift register based on the row select data, to the EPROM, wherein the row select signal is to select the specified row of EPROM cells in the EPROM;

applying a column select signal, generated by the shift register based on the column select data, to the EPROM, wherein the column select signal is to select the specified column of EPROM cells in the EPROM; and applying a bank select signal, generated by the shift register based on the bank select data, to the EPROM, wherein the bank select signal is to select the specified bank of EPROM cells in the EPROM;

wherein the row select signal, column select signal, and the bank select signal are applied to the EPROM sequentially.

14. The method as claimed in claim 13, wherein applying the row select signal further comprises:

shifting the row select data in the shift register; and providing output of the shift register to switches coupled to the shift register, the switches being controlled by a row selection enabling signal generated by a controller associated with the EPROM.

15. The method as claimed in claim 13, wherein applying the column select signal further comprises:

shifting the column select data in the shift register; and providing output of the shift register to switches coupled to the shift register, the switches being controlled by a column selection enabling signal generated by a controller associated with the EPROM.

16. The method as claimed in claim 13, wherein generating the bank select signal comprises shifting the bank select data in the shift register to overwrite the row select data and column select data.

17. The method as claimed in claim 13, further comprising, providing, to the EPROM, a read/write signal subsequent to the row select signal, column select signal, and the bank select signal.

18. The method as claimed in claim 13, wherein the row select signal, column select signal, and the bank select signal are time-multiplexed, and received by the EPROM in consecutive time segments.

* * * * *